US005415357A

United States Patent [19]

Smith, Jr.

[11] Patent Number: 5,415,357

[45] Date of Patent: * May 16, 1995

[54] PRODUCT ROLL WITH ROTATION IMPEDANCE

[76] Inventor: Jonathan R. Smith, Jr., 849 Highland Ter., NE., Atlanta, Ga. 30306

[ * ] Notice: The portion of the term of this patent subsequent to Dec. 28, 2010 has been disclaimed.

[21] Appl. No.: 143,252

[22] Filed: Oct. 27, 1993

Related U.S. Application Data

[63] Continuation-in-part of Ser. No. 835,604, Feb. 13, 1992, Pat. No. 5,273,227.

[51] Int. Cl.[6] ..... B65H 23/04; B65H 75/10

[52] U.S. Cl. ..... 42/160.1; 242/610.1; 242/610.4; 242/611; 242/156; 242/422.4; 242/592.7; 242/599.4; 242/613

[58] Field of Search ..... 242/55.2, 99, 75.4, 242/156, 160.1, 610, 610.4, 610.6, 612, 416, 421, 596.7, 597.6, 599.4, 422.4, 610.1, 118.7, 118.8, 611, 613; 4/244.2

[56] References Cited

U.S. PATENT DOCUMENTS

| | | | |
|---|---|---|---|
| 1,761,111 | 6/1930 | Doty | 242/610.1 X |
| 2,293,785 | 8/1942 | Wintz | 299/24 |
| 2,699,903 | 1/1955 | Montgomery | 242/422.4 |
| 3,145,940 | 8/1964 | Henry | 242/599.2 |
| 3,434,998 | 3/1969 | Aldrich et al. | 260/38 |
| 3,598,677 | 8/1971 | Bergmeister et al. | 156/276 |
| 3,770,221 | 11/1973 | Stern | 242/422.4 |
| 3,850,379 | 11/1974 | Stern | 242/423.1 |
| 3,865,770 | 2/1975 | Blake | 260/27 R |
| 3,895,153 | 7/1975 | Johnston et al. | 428/141 |
| 3,901,987 | 8/1975 | Payne et al. | 428/219 |
| 3,922,464 | 11/1975 | Silver et al. | 428/355 |
| 3,924,044 | 12/1975 | Gobran et al. | 428/355 |
| 3,961,966 | 6/1976 | Brinkmann et al. | 106/36 |
| 4,248,392 | 2/1981 | Parry | 242/422.1 |
| 4,285,474 | 8/1981 | Perez | 242/422.5 |
| 4,610,407 | 9/1986 | Stubbmann | 242/421.3 |
| 4,931,130 | 6/1990 | Biagiotti | 156/446 |
| 5,273,227 | 12/1993 | Smith | 242/610.4 X |

OTHER PUBLICATIONS

Betsy Pisik, "For 10 years, Post-its Stick Around" Jan. 29, 1990, p. 41, Insight Magazine.

*Primary Examiner*—John Q. Nguyen
*Attorney, Agent, or Firm*—Louis T. Isaf; Jeffrey R. Kuester

[57] ABSTRACT

A product roll includes, in its most preferred embodiment, a cylindrical core defining a core central passage for receipt of a dispenser spindle and including a core outer surface and a core inner surface, a roll of product coaxially wound around and attached to the core outer surface, and a rotation retardant attached to the core inner surface for retarding rotation of the product roll with respect to the dispenser spindle. Alternate embodiments include a cylindrical core with an adhesive filler as one component of the core mass, a multi-layered core having an inner layer defining friction-increasing projections and indentations, and a core insert with a strong outer adhesive for relative stationary engagement with the core and a weak inner adhesive for impeding rotation of the core and core insert assembly.

25 Claims, 2 Drawing Sheets

PRODUCT ROLL WITH ROTATION IMPEDANCE

CROSS-REFERENCE TO RELATED APPLICATION

This application is a continuation-in-part of application Ser. No. 07/835,604, filed Feb. 13, 1992, allowed Jul. 8, 1993, U.S. Pat. No. 5,273,227.

BACKGROUND OF THE INVENTION

The present invention relates generally to the field of rolled products and more particularly to the field of retarding dispensing of rolled products such as toilet paper, paper towels, and the like.

Rolled products are considered well-known. Many products are commercially available as product rolls, including toilet paper, paper towels, tissue paper, plastic film, metal foil, waxed paper, wrapping paper, etc. A product roll typically includes a cylindrical core having a core inner surface which defines a central passageway and a core outer surface around which the product is coaxially wound.

Rolled product dispensers are also considered well-known. A dispenser typically includes a stationary base with two base arms and a telescopic dispenser spindle removably supported by the base arms. Ordinarily, a product roll is mounted onto a dispenser spindle by first removing the dispenser spindle from the base arms, inserting the dispenser spindle through the central passageway of the cylindrical core of the product roll, and remounting the combination dispenser spindle and product roll onto the dispenser base.

After the product roll is mounted onto the dispenser, it may be dispensed through pulling the free end of the product to cause the product roll to unwind. Since a dispenser spindle frequently has a much smaller diameter than a cylindrical core of a product roll, the product roll tends to loosely rotate around the dispenser spindle as the product unwinds. After a user unwinds a desired amount of product, the user typically jerks the free end of the product to tear the product at a desired location. Such tearing is often facilitated by perforations in the product itself.

One problem related to the dispensing of product rolls arises from their tendency to unwind too much. As a user attempts to tear a rolled product, and often as a product is initially unwound, the product roll fails to tear and/or tends to continue unwinding past a desirable location. As is often the case with toilet paper, the toilet paper unwinds to a point where it covers a portion of the floor. Even if the floor is considered sanitary and the user wishes to rewind the toilet paper onto the roll, most attempts at manually rewinding toilet paper rolls produce unsightly results.

Problems related to the copious unwinding of product rolls are considered well-known. Many efforts have been made to restrain undesirable unwinding of rolled products. Several of the previous efforts are disclosed in the following U.S. Pat. Nos.: 3,770,221, 3,850,379, 4,285,474, and 4,610,407. Many of the previous efforts have involved alternately designed dispensers which appear to be expensive, complicated, and fail to make use of the large number and variety of currently installed dispensers. Others tend to restrict unwinding to such a great degree that users often unintentionally tear the product during normal unwinding.

There is, therefore, a need in the industry for a method and apparatus for solving these and other related, and unrelated, problems.

SUMMARY OF THE INVENTION

Briefly described, the present invention includes a rotation-retarded product roll, and a method for producing a rotation-retarded product roll, which product roll includes, in its most preferred embodiment, a cylindrical core defining a core central passage for receipt of a dispenser spindle and including a core outer surface and a core inner surface, a roll of product coaxially wound around and attached to the core outer surface, and a rotation retardant attached to the core inner surface for retarding rotation of the product roll with respect to the dispenser spindle.

According to one alternate embodiment of the present invention, a core is provided which, rather than including a rotation retardant attached to the core inner surface, includes a rotation retardant as one component of the core mass so that the core is itself tacky. In another alternate embodiment of the present invention, an insert is provided for placement within an ordinary core which includes a strong outer adhesive for relative stationary engagement with the core and a weak inner adhesive which is similar in substance and function to the rotation retardant of the preferred embodiment. Yet another alternate embodiment of the present invention includes a multi-layered core with an inner layer defining inner projections and indentations for impeding rotation of the core relative to the dispenser spindle.

It is therefore an object of the present invention to provide a method and apparatus for retarding dispensing of a rolled product to reduce unwanted overspin.

Another object of the present invention is to provide a rotation-retarded product roll, and a method for producing such a product roll, which product roll ordinarily unwinds without tearing the product.

Yet another object of the present invention is to provide a rotation-retarded product roll, and a method for producing such a product roll, which product roll includes a cylindrical core with a core inner surface and a rotation retardant attached to the core inner surface.

Still another object of the present invention is to provide a product roll, and a method for producing such a product roll, which product roll includes a cylindrical core with a core inner surface and a retardant adhesive covering at least a portion of the core inner surface for increasing the coefficient of friction between the cylindrical core and a dispenser spindle.

Still another object of the present invention is to provide a method for applying a residue-free, long-aging adhesive to at least a portion of a core inner surface of a cylindrical core of a product roll.

Still another object of the present invention is to provide a rotation-retarded product roll, and a method for producing such a product roll, which product roll includes a cylindrical core having a core inner surface which retards rotation of the cylindrical core with respect to a dispenser spindle.

Still another object of the present invention is to provide a cylindrical core which includes a tacky rotation retardant as part of the core mass formulation.

Still another object of the present invention is to provide a multi-layered cylindrical core with an inner layer having inner projections and indentations.

Still another object of the present invention is to provide an insert for placement within a cylindrical core which includes a strong outer adhesive and a weaker inner adhesive.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
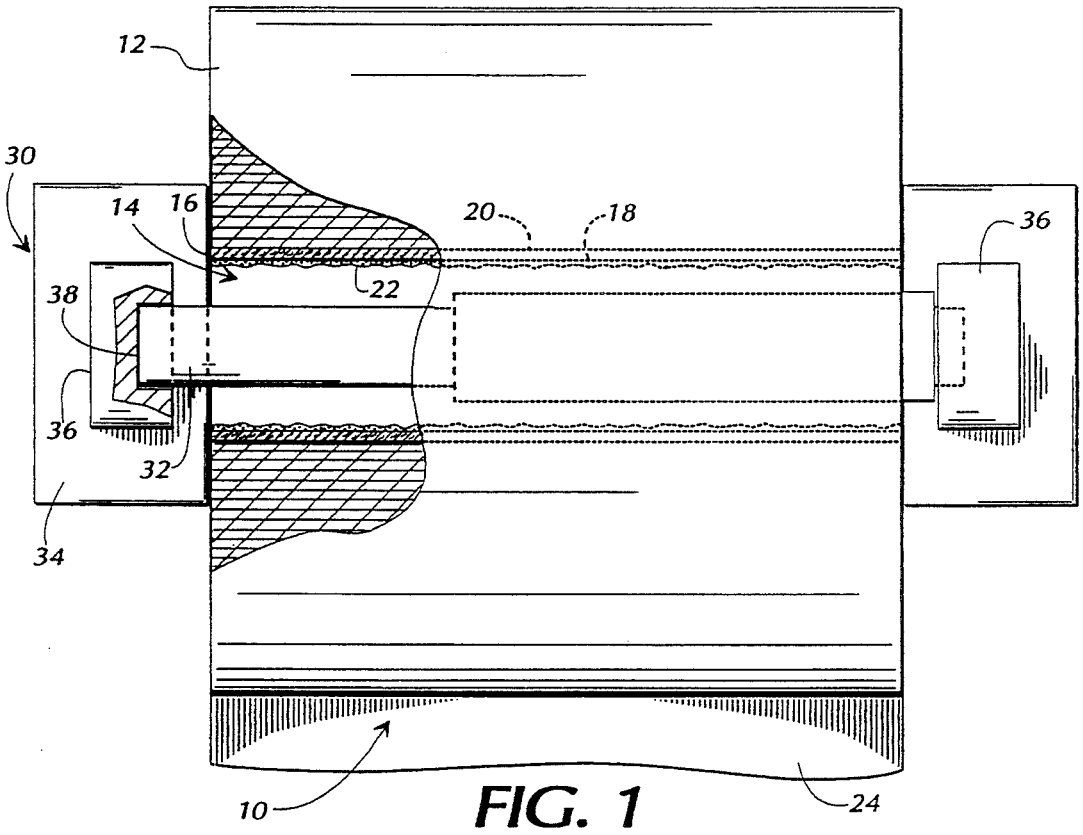
FIG. 1 is a cut-away front elevational view of a product roll mounted on a dispenser in accordance with a preferred embodiment of the present invention as applied to toilet paper.
Figure 2:
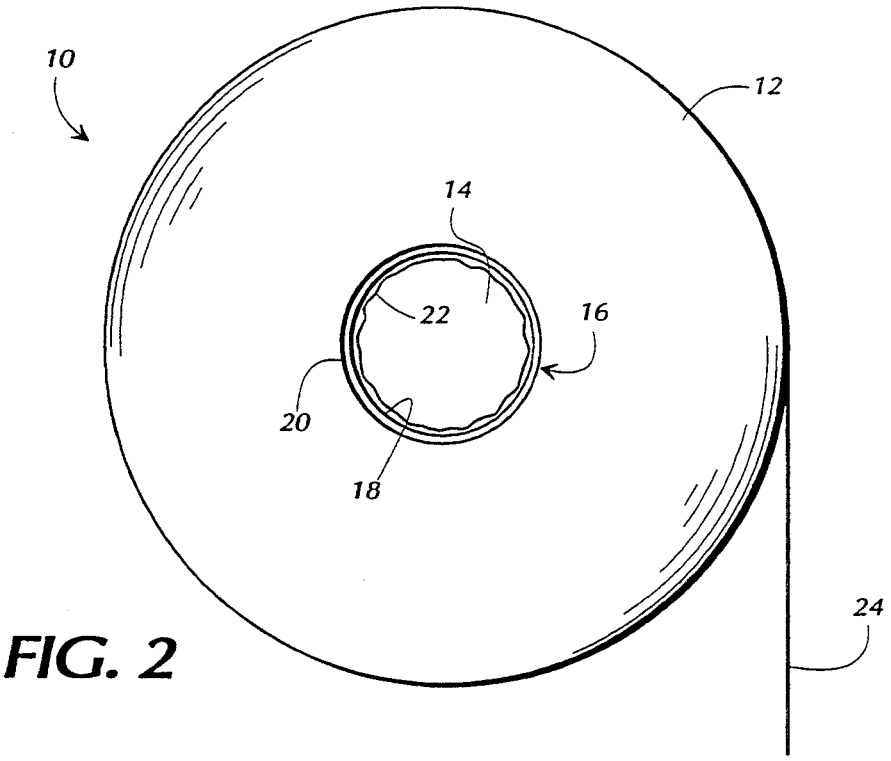
FIG. 2 is an isolated right side view of the product roll of FIG. 1.

Referring now in greater detail to the drawings, in which like numerals represent like components throughout the several views, the preferred embodiment of the present invention as applied to toilet paper is shown in FIGS. 1 and 2. Product roll 10 is shown mounted on a dispenser 30 in FIG. 1, while an isolated right side view of the product roll 10 is shown in FIG. 2. The dispenser 30 is shown including a dispenser base 34 having two base arms 36 extending outward and including arm recesses 38 which support a removable dispenser spindle 32. The dispenser spindle 32 is represented as a common telescopic toilet paper spindle having an internal biasing means (not shown) whose design and operation are considered well known by those reasonably skilled in the art.

Referring to both FIGS. 1 and 2, the product roll 10, in accordance with the preferred embodiment of the present invention, includes a cylindrical core 16 which includes a core outer surface 20 and a core inner surface 18 defining a core passage 14 for receipt of the dispenser spindle 32. Product 12 is shown coaxially wound around the core outer surface 20 and having a product free end 24. Although not shown, the inner end of the product 12 is adhesively connected to the core outer surface 20, as is considered common in the industry. In other alternate embodiments of the present invention, the inner end of the product 12 is mechanically attached to the cylindrical core 16, and in other alternate embodiments, the inner end of the product 12 is not attached by any means to the cylindrical core 16.

In accordance with the preferred embodiment of the present invention, a rotation retardant 22 covers, and is insurmountably fixed to, the entire core inner surface 18 of the cylindrical core 16. In the preferred embodiment of the present invention, the rotation retardant 22 is applied to the core inner surface 18 during manufacture of the cylindrical core 16 in a common method of applying coatings to sheet products. In an alternate embodiment of the present invention, the rotation retardant 22 is applied to the core inner surface 18 after formation of the cylindrical core 16. Also, with cylindrical cores 16 formed from multi-layered sheets, the scope of the present invention is considered to include applying the rotation retardant 22 to a layer before, in one embodiment, and after, in another embodiment, the multi-layered sheet is assembled.

One example of an acceptable substance for the rotation retardant 22 is the long-aging acrylic adhesive polymer used on Post-it TM brand products available from the 3M Co. of St. Paul, Minn. Dennison Manufacturing Co. of Framingham, Mass. also produces an adhesive commercially known as Tack-a-note ® which is another acceptable example of a substance for the rotation retardant 22. Other acceptable examples of rotation retardant 22 are common residue-free adhesives, such as those covering common types of masking tape. Still other examples include the chemicals disclosed in U.S. Pat. Nos. 3,922,464 and 3,924,044. It is understood that the choice of substance for rotation retardant 22, as well as the distribution and amount of rotation retardant 22, is affected by factors specific to the dimensions and designs of the product roll 10 and the dispenser 30.

During operation of the preferred embodiment of the present invention, a user grasps and pulls the product free end 24 until a desired amount of product 12 unwinds from the product roll 10. The user then jerks the product free end 24 to tear the product 12. During unwinding of the product 12, the cylindrical core 16 rotates with respect to the dispenser spindle 32. The rotation retardant 22 of the preferred embodiment of the present invention increases the coefficient of friction between the cylindrical core 16 and the dispenser spindle 32 by continually attempting to adhere to the dispenser spindle 32 and form a surmountable bond between the cylindrical core 16 and the dispenser spindle 32, thus reducing the willingness of the core inner surface 18 to move across the dispenser spindle 32. Since the surmountable bond is adhesive and tacky in nature, rather then merely frictional, separation is inhibited in both tangential (shear) and normal (perpendicular to the contacting surfaces) directions. By increasing the coefficient of friction between the cylindrical core 16 and the dispenser spindle 32, dispensing of the product 12 is retarded. By retarding dispensing, the rotation retardant 22 reduces the amount of undesirable unwinding. Also, by increasing the amount of tension felt by the product free end 24, the rotation retardant 22 increases the likelihood that the product 12 will tear when desired by the user.

It is intended that the scope of the present invention include various alternate embodiments of the apparatus and method disclosed herein. However, it should also be understood that each of the embodiments disclosed herein, including the preferred embodiment, includes features and characteristics which are considered independently inventive. Accordingly, the disclosure of variations and alterations expressed in alternate embodiments is intended only to reflect on the breadth of the scope of the present invention without rendering obvious or unimportant any of the specific features and characteristics of any of the embodiments.

Figure 3:
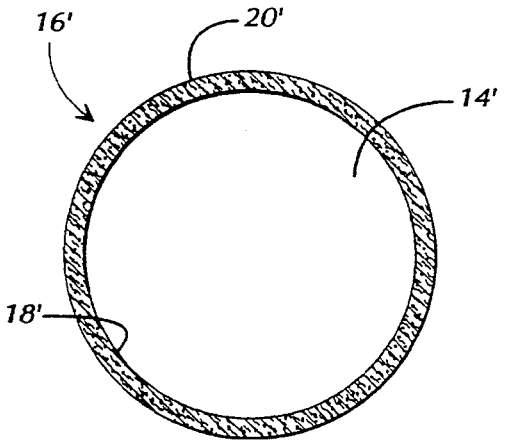
FIG. 3 is an end cross-sectional view of a cylindrical core with a tacky formulation in accordance with an alternate embodiment of the present invention.
Figure 4:
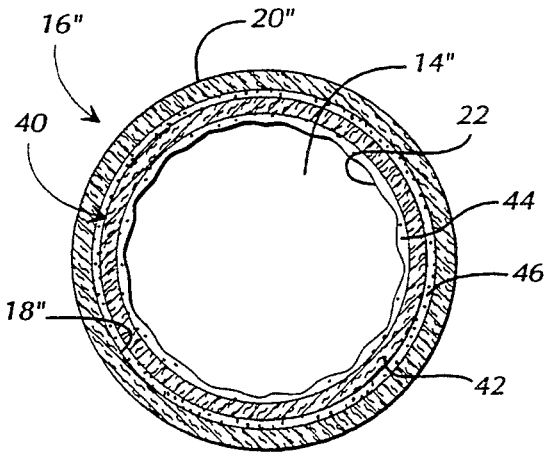
FIG. 4 is an end cross-sectional view of a cylindrical core with an insert in accordance with another alternate embodiment of the present invention.
Figure 5:
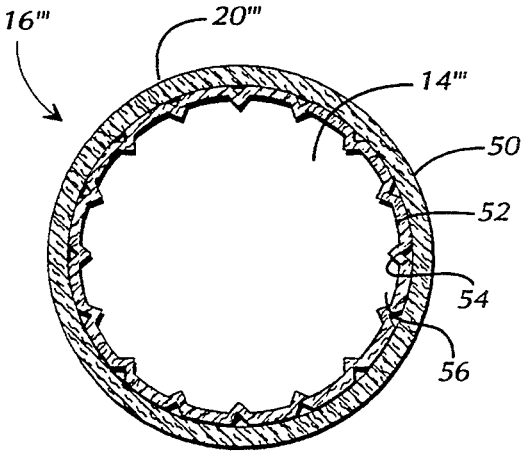
FIG. 5 is an end cross-sectional view of a multi-layered cylindrical core in accordance with another alternate embodiment of the present invention.

FIGS. 3–5 show end cross-sectional views of cylindrical cores 16', 16'', and 16''' in accordance with alternate embodiments of the present invention. Referring to FIG. 3, a cylindrical core 16' with a core outer surface 20' and a core inner surface 18' defining a core passage 14' is formed from a pulp mass having an alternate composition. An adhesive filler has been added as one component of the pulp mass during formation of the cylindrical core 16' so that the cylindrical core 16' itself has a long-aging tacky feel which causes the cylindrical core 16' to continually attempt to adhere to the dispenser spindle 32 (FIG. 1).

Refer now to FIG. 4 which shows an end cross-sectional view of a conventional cylindrical core 16'' attached to a new insert 40. The insert 40 includes an insert cylinder 42 covered by an insert interior adhesive 44 and an insert exterior adhesive 46. The insert exterior adhesive 46 is a strong adhesive for creating an insurmountable bond to attach the insert 40 to the core inner surface 18'' of the cylindrical core 16'' and ensure relative stationary engagement with the cylindrical core 16''. The insert interior adhesive 44 is a weaker adhesive similar to the long-aging rotation retardant of the preferred embodiment of the present invention whereby the combination cylindrical core 16'' and insert 40 continually attempt to adhere to and form surmountable bonds with the dispenser spindle 32 (FIG. 1) to increase friction with the dispenser spindle 32 and impede rotation. In other alternate embodiments of the present invention, the insert exterior adhesive 46 is omitted, and the insert is sized so that frictional forces alone create the relative stationary engagement between the insert 40 and the core 16''. With certain alternate embodiments of the present invention, the insert 40 is removable for use with other cores 16''.

FIG. 5 shows an end cross-sectional view of a multilayered cylindrical core 16''' which includes a core outer layer 50 and a core inner layer 52. The core outer layer 50 defines a core outer surface 20''', and the core inner layer 52 defines a plurality of core inner projections 54 and core inner indentations 56 extending into a defined core passage 14''' in a manner similar to corrugation. During operation, the projections 54 and indentations 56 increase friction between the core 16''' and the dispenser spindle 32 (FIG. 1) to impede rotation of the core 16''' without the use of adhesive materials. Other alternate embodiments of the present invention are understood to include variously shaped inner surfaces, including bumps, ridges, scored areas, etc.

It should be understood that the present invention, in a broader sense, is considered to include all product rolls having cylindrical cores with spindle engaging surfaces which are more frictionally resistive than ordinary, relatively smooth-surfaced, paper cylindrical cores. In the preferred embodiment of the present invention, (FIGS. 1 and 2) the spindle engaging surface of the cylindrical core 16 is formed by applying a rotation retardant 22, in the form of a residue-free, long-aging, pressure sensitive adhesive to a paper core inner surface 18. In an alternate embodiment of the present invention, the rotation retardant 22 is a skid-resistant substance having very little tackiness. Also, alternate patterns, including sections with varying levels of retarding, are also considered included within the scope of the present invention since it is understood that alternate dispensers contact alternate portions of the core inner surface 18. One alternately shaped dispenser commonly used with paper towel rolls includes two short spindle projections extending inwardly from the base arms. With such dispensers, annular rings of rotation retardant 22 having a greater degree of tackiness are located on opposing ends of the core inner surface 18.

The scope of the present invention is also considered to include attaching a removable protective film element over the rotation retardant 22 to maintain the tackiness thereof if necessary to increase the shelf-life of the present invention. In one such embodiment, the protective film element includes a tab for easy removal of the film by a user. In other embodiments, a rotation retardant 22 whose tackiness either increases over time or remains substantially constant is utilized. A rotation retardant 22 whose tackiness increases is understood to be valuable since it is understood that the product roll 10 tends to rotate more freely when a smaller amount of product 12 remains. It is also understood that the difference in diameter between the dispenser spindle 32 and the tacky cylindrical core 16 of the preferred embodiment of the present invention aids in preventing the dispenser spindle 32 and the product roll 10 from freely rotating together, which is especially useful with dispenser spindles 32 which are not held rigid from rotation with respect to the dispenser base 34.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the preferred relative dimensions and relationships, but the scope of the invention is not to be limited thereby.

I claim:

1. A product roll dispensable from a product dispenser having a dispenser spindle, said product roll comprising:

a cylindrical core including, at least, a core inner surface and a core outer surface and defining a core central passage for receipt of a dispenser spindle;

a roll of product coaxially wound around said core outer surface; and a resistive means covering at least a portion of said core inner surface for impeding rotation of said cylindrical core with respect to the dispenser spindle by attempting to create adhesion between said cylindrical core and the dispenser spindle.

2. A product roll of claim 1, wherein said cylindrical core includes, at least, multiple layers of core sheet material.

3. A product roll of claim 1, wherein one end of said roll of product is attached to said core outer surface.

4. A product roll of claim 1, wherein said resistive means covers all of said core inner surface.

5. A product roll of claim 1, wherein said resistive means includes, at least, a means for increasing the coefficient of friction between said cylindrical core and the dispenser spindle.

6. A product roll of claim 1, wherein said resistive means includes, at least, a means for continually attempting to adhere to the dispenser spindle to slow movement of said cylindrical core relative to the dispenser spindle.

7. A product roll of claim 1, wherein said resistive means includes, at least, a residue free, pressure sensitive adhesive.

8. A product roll of claim 1, wherein said resistive means includes, at least, a core insert.

9. A product roll of claim 8, wherein said core insert includes, at least, a sheet layer and an impeder layer.

10. A product roll of claim 9, wherein said sheet layer includes, at least, a paper cylinder, and wherein said impeder layer includes, at least, a residue free, pressure sensitive adhesive.

11. The product roll of claim 1, wherein said resistive means includes an adhesive.

12. The product roll of claim 11, wherein said adhesive defines a residue free, pressure sensitive adhesive.

13. The product roll of claim 11, wherein said adhesive retards rotation of said cylindrical core with respect to the dispenser spindle by continually attempting to adhere to the dispenser spindle.

14. The product roll of claim 13, wherein said resistive means further includes an insert for insertion into said core central passage.

15. A product roll dispensable from a product dispenser having a dispenser spindle, said product roll comprising:

a cylindrical core defining a core central passage for receipt of a dispenser spindle and including, at least, a product engagement surface and a spindle engagement surface including, at least, a retardant means for retarding rotation of said cylindrical core with respect to the dispenser spindle by attempting to create adhesion between said cylindrical core and the dispenser spindle; and a roll of product coaxially wound around said product engagement surface.

16. A product roll of claim 15, wherein said spindle engagement surface further includes, at least, a core inner surface, and wherein said retardant means is attached to, and covers at least a portion of, said core inner surface.

17. A product roll of claim 16, wherein said retardant means includes a residue free, pressure sensitive adhesive.

18. The product roll of claim 15, wherein said retardant means includes an adhesive.

19. The product roll of claim 18, wherein said adhesive defines a residue free, pressure sensitive adhesive.

20. The product roll of claim 18, wherein said adhesive retards rotation of said cylindrical core with respect to the dispenser spindle by continually attempting to adhere to the dispenser spindle.

21. The product roll of claim 20, wherein said retardant means further includes an insert for insertion into said core central passage.

22. The product roll of claim 20, wherein said cylindrical core is defined by a core composition, and wherein said retardant means defines an adhesive filler of said core composition.

23. In combination:

a dispenser spindle;

a product roll including a cylindrical core rotatably supported on said dispenser spindle and a roll of product coaxially wound around said cylindrical core; and adhesive means interposed between said dispenser spindle and said cylindrical core for impeding rotation of said product roll with respect to said dispenser spindle by attempting to create adhesion between said dispenser spindle and said cylindrical core.

24. The combination of claim 23, wherein said adhesive means includes an adhesive insurmountably fixed to said cylindrical core.

25. The combination of claim 24, wherein said adhesive means continually attempts to adhere to said dispenser spindle.

* * * * *